US005251551A

United States Patent [19]

Abe et al.

[11] Patent Number: 5,251,551

[45] Date of Patent: Oct. 12, 1993

[54] CALENDERING APPARATUS FOR PAPER MAKING PROCESS

[75] Inventors: Tsuyoshi Abe; Jun Kobayashi, both of Tokyo, Japan

[73] Assignee: Jujo Paper Co., Ltd., Tokyo, Japan

[21] Appl. No.: 844,284

[22] Filed: Mar. 2, 1992

Related U.S. Application Data

[63] Continuation-in-part of Ser. No. 729,563, Jul. 15, 1991, abandoned, which is a continuation of Ser. No. 413,243, Sep. 27, 1989, abandoned.

[30] Foreign Application Priority Data

Sep. 29, 1988 [JP] Japan ..... 63-245524

[51] Int. Cl.[5] ..... B30B 15/34; B30B 5/04; D21G 1/00

[52] U.S. Cl. ..... 100/93 RP; 100/153; 100/162 R; 162/358.4; 162/358.5

[58] Field of Search ..... 100/38, 93 RP, 153, 100/156, 160, 161, 162 R, 151; 162/206, 207, 358.2, 358.4, 358.5, 360.3

[56] References Cited

U.S. PATENT DOCUMENTS

| | | | |
|---|---|---|---|
| 1,327,225 | 1/1920 | Darby | 100/162 R |
| 2,209,759 | 7/1940 | Berry | 100/153 X |
| 2,556,008 | 6/1951 | Spalding | 100/93 RP X |
| 2,663,052 | 12/1953 | Goulding, Jr. et al. | 100/153 |
| 2,997,406 | 9/1961 | Freeman et al. | 100/160 X |
| 3,055,496 | 9/1962 | Dunlap | 100/153 X |
| 3,124,504 | 3/1964 | Mahoney et al. | 100/93 RP X |
| 3,286,360 | 11/1966 | Walker | 100/153 X |
| 3,365,774 | 1/1968 | Kusters | 100/162 R X |
| 3,556,940 | 1/1971 | Cronin | 162/358.2 |
| 4,001,544 | 1/1977 | Heinzer et al. | 100/93 RP X |
| 4,552,620 | 12/1985 | Adams | 100/151 |
| 4,606,264 | 8/1986 | Agronin et al. | 100/93 RP X |
| 4,889,048 | 12/1989 | Miller | 100/93 RP |
| 4,976,820 | 12/1990 | Laapotti | 100/93 RP X |

FOREIGN PATENT DOCUMENTS

| | | | |
|---|---|---|---|
| 1337806 | 8/1963 | France | 100/162 R |
| 2588293 | 4/1987 | France | 100/162 R |
| 968938 | 9/1964 | United Kingdom | 100/93 RP |

*Primary Examiner*—Stephen F. Gerrity
*Attorney, Agent, or Firm*—Burns, Doane, Swecker & Mathis

[57] ABSTRACT

A calendering apparatus in which a nip portion is formed by a chilled roll, a backing roll and an endless elastic belt arranged over the backing roll, wherein a paper sheet to be treated passes between the chilled roll and the endless elastic belt. Thus, a paper sheet having a remarkably improved smoothness and gloss can be obtained by the calendering apparatus of the present invention using an endless elastic belt having a relatively long length, without the disadvantage of a heat build-up occurring in a usual calendering treatment. A contacting angle between the belt and the backing roll is 30° or less.

11 Claims, 4 Drawing Sheets

CALENDERING APPARATUS FOR PAPER MAKING PROCESS

RELATED APPLICATION

This is a continuation-in-part of U.S. application Ser. No. 07/729,563 filed Jul 15, 1991 which, in turn, is a continuation application of U.S. application Ser. No. 07/413,243 filed Sep. 27, 1989, now abandoned.

BACKGROUND OF THE INVENTION

1. Field of the Invention

The present invention relates to a calendering apparatus for a paper making process. More particularly, the present invention relates to a calendering apparatus used for improving the surface properties of a paper sheet by applying a smoothness, a gloss or the like to a surface of the paper sheet.

2. Description of the Related Art

Many types of calendering apparatuses are used in a paper making process; typical of which are a machine calender, i.e., a chilled nip calender, and a supercalender.

The machine calender is arranged directly down stream of a drying part in a paper making machine, i.e., in an on-line arrangement to improve the surface properties of the paper sheet, and includes at least a nip formed by two chilled rolls made of a steel.

In the supercalender the chilled roll is arranged in a vertical direction alternately with an elastic roll, and the supercalender is used as an apparatus independent of the paper making machine, i.e., in an off-line arrangement. The supercalender forms several nips through which paper passes under a high pressure to produce a paper sheet having a superior smoothness, such as a gravure printing paper.

Further, a soft nip calender apparatus including a nip formed by the elastic roll and the chilled roll as a pair has been developed, and is used in an on-line arrangement like the machine calender.

The supercalender is usually driven off-line at a low speed, due to the need to take into consideration a possible deterioration of the elastic roll when operated under high pressure and multiple nips conditions. Therefore, in a calendering treatment of the paper sheet, the machine calender or the soft nip calender is most widely used.

The function of the soft nip calender using the elastic roll is clearly different from that of the machine calender with regard to improving the surface properties of a paper sheet, and this difference will be explained with reference to FIGS. 1 and 2. In those figures, a change in the surface of the paper sheet caused by a treatment with the machine calender is illustrated by a conventional cross section in a widthwise direction perpendicular to a running direction of the paper sheet in FIG. 1, and a change caused by the conventional soft nip calender is illustrated in FIG. 2, in the same manner as in FIG. 1.

A cross section in the widthwise direction of the paper sheet before the calendering treatment is illustrated in FIG. 1(A) and FIG. 2(A) respectively. As can be seen in FIG. 1(A) and FIG. 2(A), a thickness of the paper sheet just after a drying process is irregular; i.e., the paper sheet 10, 10' has thick portions 10*a*, 10*a'* and thin portions 10*b*, 10*b'*. A cross sectional shape of the paper sheet 10 while being nipped by two chilled rolls 50 of the machine calender is illustrated in FIG. 1(B), and a cross sectional shape of the paper sheet 10, 10' while being nipped by a chilled roll elastic roll 51 of the soft nip calender is illustrated in FIG. 2(B). In the former case, a surface layer of the thick portion 10*a* of the paper sheet 10 is made smooth by a pressing action of the chilled roll, but since a surface layer of the thin portion 10*b* of the paper sheet 10 does not come into contact with the chilled roll 50, small untreated portions remain on the paper sheet 10. In the latter case, when the paper sheet 10' is pressed with the chilled roll 50 and the elastic roll 51, a surface 11*a* opposite to the chilled roll 50 of the paper sheet 10' is made flat by the even cylindrical surface of the chilled roll 50, and the irregular shape of the surface 11*a* before the calendering operation is transferred to and duplicated at another surface 11*b* of the paper sheet 10'. The elastic roll 51 is deformed in accordance with the duplicated irregular shape of the surface 11*b*, due to its own elasticity, and accordingly, the surface 11*a* is made and remains smooth during the first stage of the calendering treatment and has a required gloss. The paper sheet 10' is then again treated by another calendering unit in which the chilled roll and the elastic roll are arranged in a reversed relationship, and thus the surface 11*b* is made flat. Accordingly, both surfaces 11*a* and 11*b* are then smooth and have the desired gloss.

The cross sectional shapes of the paper sheets after receiving the calendering treatment are illustrated in FIGS. 1(C) and 2(C). As can be seen from FIG. 1(C), the paper sheet treated with the machine calender has a substantially uniform thickness but the density and surface properties thereof are irregular. Further as can be seen from FIG. 2(C), the paper sheet treated with the soft nip calender has an irregular thickness but the density is constant, and thus the surface properties are improved in that the surface smoothness is uniform. Portions 12, 12' which are affected by the calendering treatment of the surface layer of the paper sheet in FIG. 1(C) and FIG. 2(C) are shown by double-hatching.

The surface of the paper sheet is made smoother by the soft nip calender, and therefore, the printability of the paper sheet treated with the soft nip calender is, superior to that of the paper sheet treated with the machine calender.

Nevertheless the soft nip calender has the following drawbacks. First the elastic roll of the soft nip calender is constructed by a layer of a synthetic resin having a high thermal resistance covering a metallic roll. The synthetic resin layer has an extremely low conductivity and a large coefficient of thermal expansion compared with the surface of the metal roll. Therefore, when the paper sheet in which a distribution of a water content and/or a weight per unit area of the paper sheet is irregular, or in which small fiber blocks are included, is treated with the soft nip calender, heat is retained by portions of the elastic roll in contact with thick portions of the paper sheet, and accordingly problems such as peeling at a boundary between the metallic roll and the synthetic resin layer, or the elastic roll becomes useless because the heated portion of the synthetic resin layer cannot resume its original shape, due to heat stress hysteresis, will occur.

Note that the calendering treatment should therefore not be carried out at a high temperature and a high pressure, as this will shorten the working life of the elastic roll. In particular, when the elastic roll is used on-line in an apparatus in which the running speed of the paper sheet is very high, the condition of the elastic roll must be closely observed at all times.

Consequentially, although the use of the elastic roll provides a superior effect, when the calendering apparatus including the elastic roll is continuously used in an actual industrial operation, often the use of the elastic roll does not provide a satisfactory calendering treatment capable of producing a paper sheet having a desired quality.

SUMMARY OF THE INVENTION

An object of the present invention is to solve the above problem caused by the elastic roll and to provide a calendering apparatus capable of producing a paper sheet having the same level of quality as that of a paper sheet treated by a calendering apparatus including the elastic roll.

Therefore, according to the present invention, there is provided a calendering apparatus for a paper making process including at least a nip constituted by two rolls, wherein the two rolls are a chilled roll and a backing roll, and an endless elastic belt having a longer length than a circumferential length of the backing roll is arranged over a nip portion of the backing roll so that the endless elastic belt is moved by a rotation of the backing roll and nips a paper sheet with the chilled roll at the nip portion thereof.

The contacting angle between the belt and the backing roll is 30° or less, and more preferably is 10° or less, in order to reduce the rate of heat-induced deterioration of the belt.

The calendering apparatus in accordance with the present invention can be applied to a paper sheet without a coating layer on a surface thereof and a paper sheet with a coating layer on a surface thereof. The latter paper sheet includes an art paper, a coated paper, or a recording paper such as a heat sensitive recording paper, a pressure sensitive recording paper, and an ink jet recording paper.

In the calendering apparatus in accordance with the present invention, when a paper sheet passes through a nip portion, a surface of the paper sheet (hereinafter referred to as a front surface) is pressed by the chilled roll, and another surface of the paper sheet (hereinafter referred to as a back surface) is pressed by the endless elastic belt. In this case, any irregularities of the front surface, i.e., concave portions and convex portion of the front surface, are made uniform, and these irregularities of the front surface are transferred to the back surface, whereby the irregularities of the front surface of the paper sheet are added to the irregularities of the back surface. This amplified irregularity of the back surface is completely observed by an elasticity of the endless elastic belt, and accordingly, the chilled roll can apply uniform a smoothness and gloss to the front surface not having irregularities.

A partial heat build-up may be generated in the endless elastic belt upon applying the surface treatment, but since the endless elastic belt has a relatively long length compared with a circumferential length of the backing roll, i.e., the endless elastic belt has a portion not in contact with the nipping portion, a heated portion of the endless elastic belt is sequentially dissipated or cooled when not in contact with the chilled roll, whereby heat stress in the endless elastic belt is reduced and the elasticity of the endless elastic is recovered. This portion is then circulated until in contact with the nipping portion. Therefore, according to the present invention, an abnormal high temperature and a deformation of the endless elastic belt is prevented. Note, to lower the temperature of the endless elastic belt, preferably a cooling device is arranged at a position near to a pathway of the endless elastic belt.

DESCRIPTION OF THE PREFERRED EMBODIMENTS

The calendering apparatus in accordance with the present invention is described in detail with reference to the attached drawings illustrating an embodiment of the calendering apparatus of the present invention.

Figure 3:
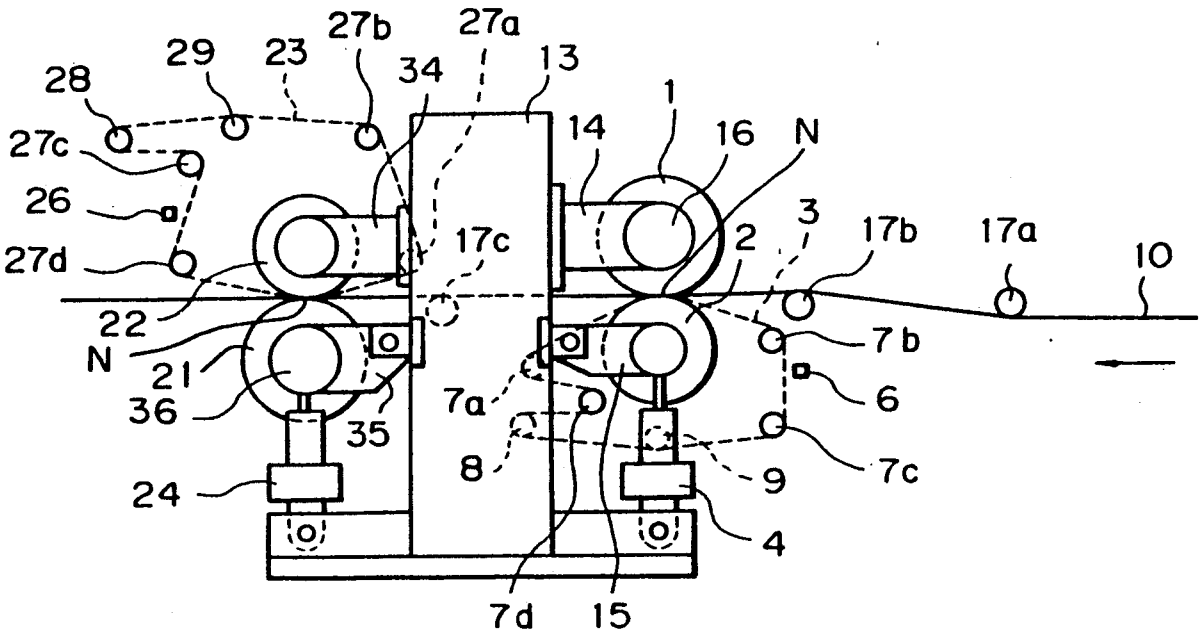
FIG. 3 is a schematic front view illustrating an embodiment of a calendering apparatus in accordance with the present invention; and, FIGS. 4 to 7 are schematic views illustrating various arrangements of an endless elastic belt in the calendering apparatus in accordance with the present invention.

As shown in FIG. 3 illustrating an embodiment of a calendering a apparatus in accordance with the present invention, a chilled roll 1 is rotatably mounted on a calender frame 13 through a fitting arm 14. A backing roll 2 arranged in a mutually opposing state in a vertical direction at a position below the chilled roll 1 is mounted on a movable fitting arm 15 having one pivotably arranged on the calender frame 13. The backing roll 2 is provided with a device for rotating the backing roll 2 (not shown). Further a drive portion of a lift up device 4 is fixed to a free end of the movable fitting arm 15, whereby the movable fitting arm 15 is swung up about the pivoting point by a pressure of the lift up device 4, and the backing roll 2 is brought into contact with the chilled roll 1 under pressure. An endless elastic belt 3 is arranged such that a portion of the endless elastic belt 3 covers a nipping portion N of the backing roll 2 while pressing against the backing roll, and the elastic belt 3 runs over the backing roll 2, as well as belt-supporting rolls which take the form of: retaining rolls 7*a*, 7*b*, 7*c* and 7*d*, a stretching roll 8, and a guide roll 9. When the free end of the movable fitting arm 15 is swung up by the lift up device 4, the pathway of the endless elastic belt 3 is adjusted by a change of a position of the guide roll 9, and a tension of the endless elastic belt 3 is adjusted by a change of a position of the stretching roll 8.

The chilled roll 1 includes a heating means 16 heated by a heating medium, such as steam, hot water, electric induction or the like. Further, a cooling device 6 such as an air shower, a water spraying device or the like is arranged at a position near to a pathway of the endless elastic belt 3, so that a cooling action is applied toward the heated endless elastic belt 3 and the heated endless elastic belt 3 is suitably cooled. Sheet rolls 17*a*, 17*b* are arranged to supply the paper sheet 10 between the chilled roll 1 and the endless elastic belt 3.

In accordance with the present invention, the area of contact between the belt and backing roll is minimized by limiting the contacting angle A (see FIG. 4) of the endless elastic belt around the backing roll at a nip portion of the backing roll to 30° or less, and more preferably to 10° or less. When a length of the endless elastic belt in contact with the backing roll is large, the belt is likely to be damaged by heat accumulated in the backing roll, thus reducing the life of the belt. By limiting the contacting angle in accordance with the present invention, the length of the belt in contact with the backing roll is correspondingly limited, and the belt life is extended. Since the calendering effect applied to paper is generated by the nipping action between the backing roll and the chilled roll, there is no possibility of the calendering effect becoming adversely affected by making the contacting angle of the belt too small.

When the paper sheet 10 is treated by a calender having only one set of rolls composed of the chilled roll 1, the backing roll 2 and the endless elastic belt 3 as described above, the surface in contact with the chilled roll 1 of the paper sheet, i.e., the front surface thereof, is made smooth compared with the surface in contact with the endless elastic belt 3, i.e., the back surface thereof.

Figure 1:
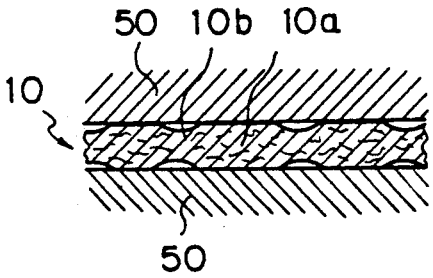
Fig. 1 (B) PRIOR ART

Therefore, when it is necessary to provide both surfaces of the paper sheet with the same smoothness, preferably a second set of rolls in which the components are arranged in reverse to those of the first set of rolls, and the paper sheet is passed through the second set of rolls after being treated by the first set of rolls. In FIG. 1, the second set rolls is arranged at the side of the calender frame 11 from which the paper sheet is output. In the second set of rolls, an endless elastic belt 23 is in contact with the paper sheet 10 from above, and a backing roll 22 over which the endless elastic belt 23 is arranged is mounted on a movable fitting arm 34 mounted at a upper position of a pathway of the paper sheet 10. The backing roll 22 is connected with a device for rotating the backing roll 22 (not shown). The endless elastic belt 23 is arranged over the backing roll 22, retaining rolls 27*a*, 27*b*, 27*c* and 27*d*, a stretching roll 28. A guide roll 29 is pressed against a surface of the backing roll 2 under a tension adjustable by the stretching roll 28. A cooling device 26 is mounted at a position near to the pathway of the endless elastic belt 23. The chilled roll 34 including a heating means 36 is pivotally arranged on a calender frame 13 via a movable fitting arm 34, and can be brought into contact with the backing roll 22, under pressure, by an upward operation of a lift up device 24.

Figure 1A:
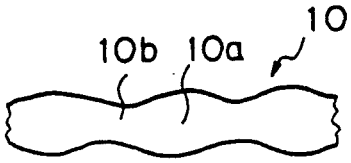
Fig. 1(A) PRIOR ART
FIGS. 1(A) to 1(C) are cross sectional views illustrating various changes of cross sections in a widthwise direction perpendicular to a running direction of paper sheets during one conventional calendering treatment of the paper sheet.
Figure 2A:
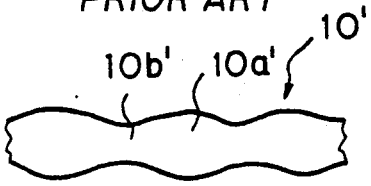
Fig. 2(A) PRIOR ART
FIGS. 2(A) to 2(C) are cross sectional views illustrating various changes of cross sections in a widthwise direction perpendicular to a running direction of paper sheets during a calendering treatment of a paper sheet in accordance with another conventional calendering treatment.
Figure 2B:
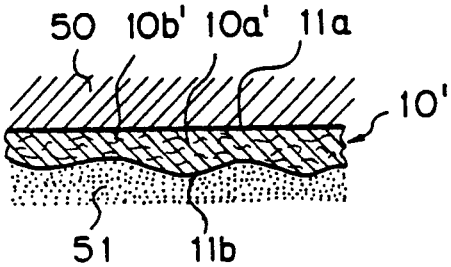
Fig. 2(B) PRIOR ART
Figure 1:
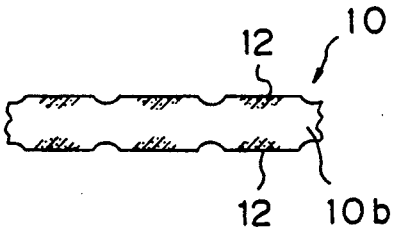
Fig. 1 (C) PRIOR ART
Figure 2C:
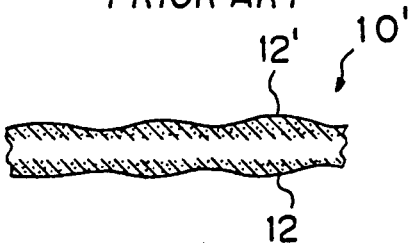
Fig. 2(C) PRIOR ART

When the above described calendering apparatus is operated by a rotation of the backing rolls 2 and 22 and the paper sheet 10 is supplied to the calendering apparatus, the front surface of the paper sheet 10 is treated by the first set of rolls and the back surface of the paper sheet is treated by the second set of rolls. At this stage, the lift up devices 4 and 24 lift corresponding movable fitting devices 15 and 35, respectively, upward, and accordingly the backing roll 2 is pressed against the chilled roll 1 and the chilled roll 21 is pressed against the backing roll 22. Since the endless elastic belts 3 and 23 are arranged over the backing rolls 2 and 22, respectively, the paper sheet 10 is pressed between the endless elastic belts 3 and 23 and the chilled rolls 1 and 21, to smooth the surfaces thereof. That is, when the paper sheet is pressed against the chilled rolls 1 and 21, all irregularities of both surface of the paper sheet 10 are absorbed by the endless elastic belts 3 and 23, and thus the chilled roll 1 and 21 can smooth the surfaces of the paper sheet and apply the gloss to those surfaces. The surfaces of the paper sheet treated with the calendering apparatus illustrated in FIG. 3 are the same as those of the paper sheet described with reference to FIG. 2.

Preferably, the backing rolls 2 and 22 are metallic rolls, and a chilled roll per se may be used as the backing roll or a crown controlled roll may be used to adjust a thickness of the paper sheet. The chilled roll has no elasticity on a surface thereof, and the heating devices 16 and 36 can be omitted depending on the quality of the paper sheet to be manufactured.

The structure of the endless elastic belts 3, 23 is not limited, and the endless elastic belt is usually formed by adhering or coating a synthetic resin having a heat resistance, a pressure resistance, and a good compression elasticity, to a fabric made of fibers having a heat resistance. Also, preferably the surface of the endless-elastic belt is polished to a surface roughness of between 1 μm and 20 μm. A preferable range of the elasticity of the synthetic resin is a shore hardness D of between 50 and 75. The hardness may be adjusted in accordance with the type of resin used, or a type or a quantity of an additive added to the resin. Generally, the lower the hardness, the better the smoothness and gloss of the paper sheet, but preferably the elasticity of the resin has is at least capable of following a surface roughness of the paper sheet to be treated. Accordingly, when the hardness of the resin is too low, plastic deformation may occur, and thus the life of the belt may be shortened. If the hardness of the resin is too high, the belt cannot follow the surf ace roughness of the paper sheet be treated and the desired smoothness and gloss cannot be obtained.

The thickness of the synthetic resin layer of the belt can be made thinner, to control heat build-up and prolong the life of the elastic belt, but a surface treated with such an endless elastic belt will probably have a surface similar to a surface treated with a chilled nip calender. Conversely, if the thickness of the synthetic resin layer of the belt is made thicker, the surface of the paper sheet is improved, but if the thickness of the belt is too thick, the durability of the belt is poor. Therefore, a preferable thickness of the synthetic resin layer is between 1 mm and 10 mm. An endless elastic belt having a synthetic resin layer on both side thereof is suitable for a polishing operation, because the synthetic resin layer opposite to the synthetic resin layer to be polished can be firmly held on a polishing table during the polishing operation. If the endless elastic belt having a sufficient strength can be obtained by only the synthetic resin layer, it is not necessary to use the base fabric. Further, it is possible to use a belt made of a rubber, a metal or the like in stead of the base fabric.

With regard to a method of rotating or driving the pair of rolls or the endless elastic belt, a rotating or drive apparatus may be arranged at either one of the pair of rolls or at the endless elastic belt.

Preferably, a rotating device is provided at the pair of rolls and a drive device at the endless elastic belt, to lower the load imposed on the endless elastic belt at a start of the operation of the apparatus.

FIGS. 4–7 illustrate various examples of the arrangement of an endless elastic belt.

Figure 4:
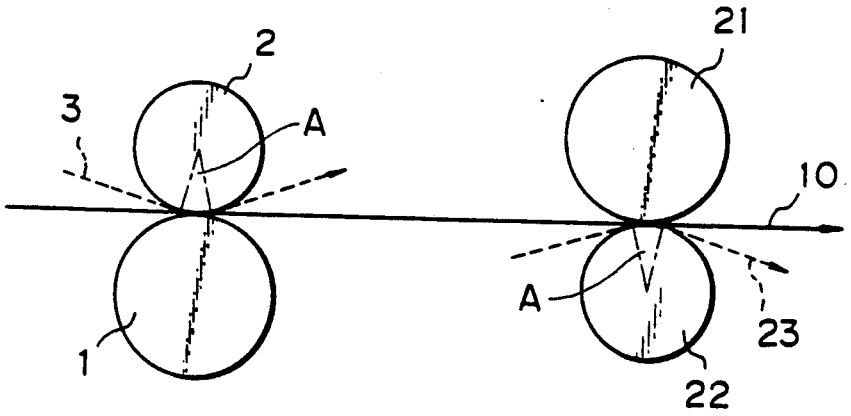

In the arrangement illustrated in FIG. 4, the second set of rolls includes a chilled roll 21, a backing roll 22, and an endless elastic belt 23 arranged in reverse to the arrangement of a first set of rolls including a chilled roll 1 a backing roll 2 and an endless elastic belt 3. Both surfaces of a paper sheet 10 are treated in the same way as described with reference to FIG. 3.

Figure 5:
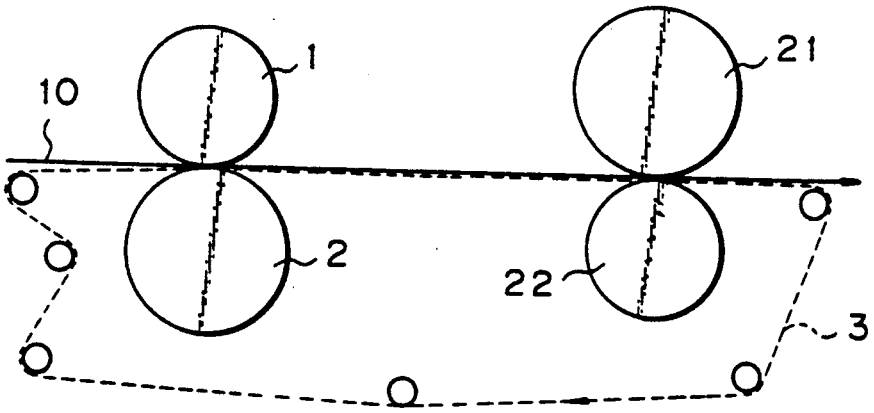
Figure 6:
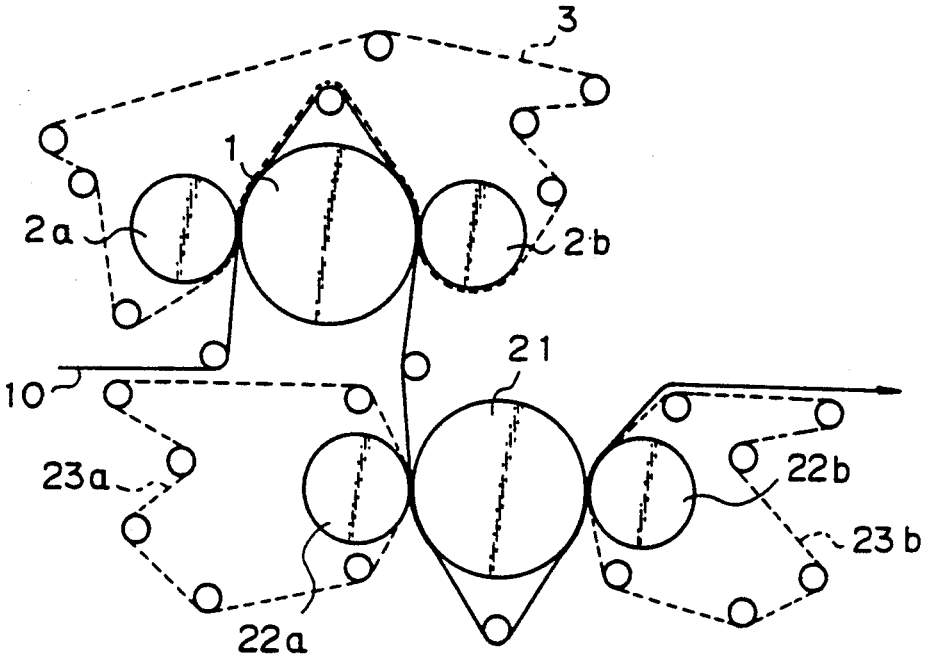

In the arrangement illustrated in FIG. 5, one side surface of a paper sheet is treated twice by two chilled rolls of two sets of rolls, to provide a smoother surface. In this case, one endless elastic belt is used for both sets of rolls and is used as a guide for the paper sheet. In the arrangement illustrated in FIG. 6, four nips are use to twice treat each surface. Namely, two backing rolls 2*a*, and 2*b* are arranged with a chilled roll 1, and an endless elastic belt 3 is arranged over the two backing rolls 2*a* and 2*b* and the chilled roll 1, and two backing rolls 22*a* and 22*b* are arranged with the chilled roll 21 and two endless empty belts 23*a* and 23*b* are independently arranged over the two backing roll 22*a* and 22*b*.

Figure 7:
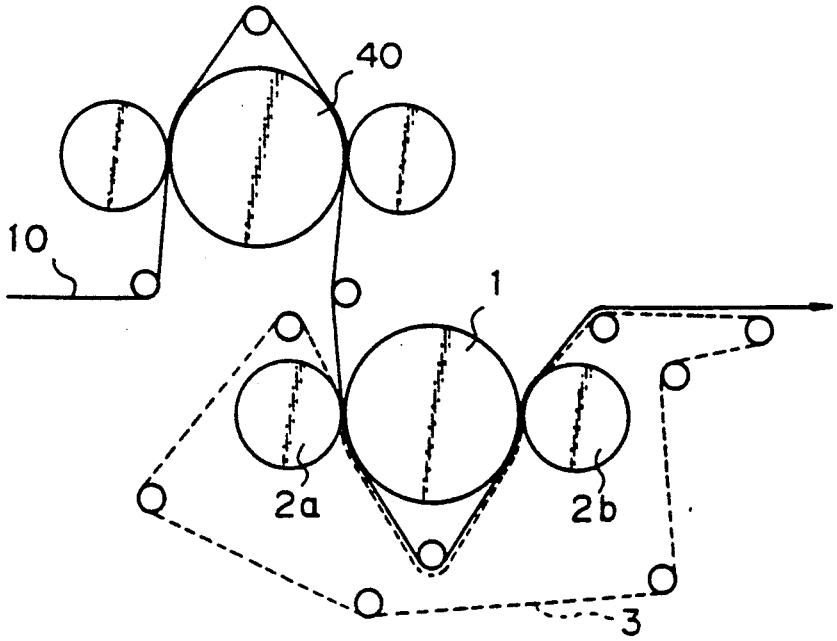

In the arrangement illustrated in FIG. 7, a paper sheet 10 pretreated by a machine calender 4 is treated by a set of rolls having the same arrangement as that illustrated in an upper portion in FIG. 7, to treat the same surface of the paper sheet with two nips. The conventional machine calender can be easily converted to an calendering device in accordance with the present invention.

The above arrangements of the components constituting the calendering apparatus in accordance with the present invention are only examples, and it is apparent that the present invention can be attained by suitable combination of any of the above, in accordance with the desired qualities of the paper sheets to be treated.

The following tests were performed to show the different effects obtained by the calendering apparatus in accordance with the present invention and a conventional chilled nip calender.

Examples 1, and 2 of the present invention were produced by the calendering apparatus having the constitution illustrated in FIG. 3, by changing a shore hardness of the endless elastic belt. The composition of the endless elastic belt was as follows:

Base-Fabric

Warp Yarn, i.e., a yarn parallel to a running direction of the belt: Nylon monofilament having a diameter of 0.43 mm Weft Yarn: Nylon monofilament having a diameter of 0.52 mm Weaving pattern: Double face fabric Thickness: 1.8 mm Coating A urethane resin was coated on a surface of the base fabric by an extruder so that the urethane resin is permeated the base fabric, and the surface was polished.

Thickness of the surface layer of the urethane resin: 1.67 mm

Shore hardness D of the surface of the urethane resin: 0.70 (Example 1)

55 (Example 2)

Roughness of the polished surface of the urethane resin: 16 μm

In the comparative Example, a conventional chilled nip calender having two nips was used.

The calendering treatments of Examples 1, 2 and Comparative Example were performed by treating a free sheet having a weight per unit area of 64 g/m 2 with two nips at a line pressure of 56 kg/cm and a roll temperature of 700° C., and a running speed of the paper of 1000 m/sec.

The results of the above tests are shown in Table 1.

TABLE 1

| Properties of Paper Sheet | | Example 1 Shore hardness D 70 | Example 2 Shore hardness D 55 | Comparative Example Chilled Nip Calendar |
|---|---|---|---|---|
| Mean Density ($g/cm^2$) | | 0.82 | 0.81 | 0.84 |
| Smoothness | F | 64.8 | 68.6 | 56.3 |
| (Sec) | W | 61.4 | 65.7 | 39.3 |
| Gloss | F | 10.8 | 11.2 | 7.9 |
| (%) | W | 9.7 | 10.3 | 6.0 |

Note
Smoothness: JIS P-8119
Gloss: JIS P-8142
F: Surface in contact with a felt during the paper making process
W: Surface in contact with a wire during the paper making process As can be seen from Table 1, the paper sheets treated with the calendering apparatus in accordance with the present invention have a superior smoothness and gloss, and differences between the smoothness and the gloss of the front surface denoted as F in Table 1 and the back surface denoted as W in Table 1 are small.

It is apparent that it is possible to improve the smoothness and the gloss of the paper sheet-by the treatment using the calendering apparatus of the present invention, compared with the treatment using the conventional chilled nip calender, and to remarkably increase the working life of an elastic belt opposing the chilled roll, compared with a conventional elastic roll. Further, since a treatment under a high pressure and a high temperature can be performed in the calendering apparatus in accordance with the present invention, it become possible to produce a paper sheet having remarkably improved qualities and printability.

Although the present invention has been described in connection with preferred embodiments thereof, it will be appreciated by those skilled in the art that additions, modifications, substitutions, and deletions not specifically described may be made without departing from the spirit and scope of the invention as defined in the appended claims.

What is claimed is:

1. A calendering apparatus for performing a calendering treatment on a paper sheet to smooth a surface of the paper sheet in a paper making process, said apparatus including at least one nip formed by two rolls, said two rolls comprised of a chilled roll and a backing roll, means for heating said chilled roll whereby said chilled roll heats the paper sheet, said backing roll including a metallic outer periphery, and an endless elastic belt having a longer length than a circumferential length of said outer periphery of said backing roll, said belt arranged in contact with both said paper sheet and a nip-defining portion of said outer periphery of said backing roll so that said belt can be moved by a rotation of said backing roll to nip said surface of the paper sheet against said chilled roll in said nip, and a contacting angle of the endless elastic belt around the backing roll at the nip portion of the backing roll being 30 degrees or less, whereby irregularities of said paper sheet surface are transferred to a back surface of said paper sheet, a plurality of belt-supporting rolls spaced from said chilled roll and said backing roll, said belt passing around said belt-supporting rolls in contact therewith.

2. A calendering apparatus according to claim 1, wherein said contacting angle is 10 degrees or less.

3. A calendering apparatus according to claim 1, wherein a second nip is formed by arranging an additional backing roll against said chilled roll, said endless elastic belt passing through said second nip, whereby a calendering treatment of a surface of the paper sheet is performed twice.

4. A calendering apparatus according to claim 1, wherein a cooling device is arranged at a position near to a pathway of the endless elastic belt, to cool the endless elastic belt.

5. A calendering apparatus according to claim 4, wherein the cooling device is an air shower.

6. A calendering apparatus according to claim 4, wherein the cooling device is a water spraying device.

7. A calendering apparatus according to claim 4, wherein said cooling device is spaced from said backing roll.

8. A calendering apparatus according to claim 1 including a second nip formed by a second chilled roll and a second backing roll, a second endless elastic belt extending through said second nip, and a second plurality of belt-supporting rolls for supporting said second belt, said nips arranged to perform calendering treatments to opposite surfaces, respectively of said paper sheet.

9. A calendering apparatus according to claim 1 including cooling means arranged for cooling a portion of said belt located outside of said nip.

10. A calendering apparatus according to claim 1, wherein said belt extends in a straight line from said nip portion to at least one of said belt-supporting rolls.

11. A calendering apparatus according to claim 1, wherein a second nip is formed by providing an additional chilled roll and an additional backing roll, said elastic belt passing through both of said first and second nips, said nips arranged to perform calendering treatments to opposite surfaces, respectively, of said paper sheet.

* * * * *